US006090023A

United States Patent [19]

Liu

[11] Patent Number: 6,090,023

[45] Date of Patent: Jul. 18, 2000

[54] BODY EXERCISER

[76] Inventor: Chao-Jih Liu, No. 166, Kung-Yeh Rd, Taichung Hsien, Taiwan

[21] Appl. No.: 09/491,107

[22] Filed: Jan. 25, 2000

[51] Int. Cl.[7] ..... A63B 21/02

[52] U.S. Cl. ..... 482/140; 482/130; 482/908

[58] Field of Search ..... 482/140, 130, 482/132, 72, 121, 122, 123, 124, 127, 133, 142, 125, 908

[56] References Cited

U.S. PATENT DOCUMENTS

| | | | |
|---|---|---|---|
| 5,752,901 | 5/1998 | Lee | 482/130 |
| 5,772,563 | 6/1998 | Lin | 482/140 |
| 5,776,042 | 6/1998 | Szabo | 482/140 |
| 5,871,425 | 2/1999 | Gvoich | 482/142 |

*Primary Examiner*—Stephen R. Crow
*Attorney, Agent, or Firm*—Merchant & Gould P.C.

[57] ABSTRACT

A body exerciser includes a base frame with two support rods provided with first coupling members, and a handle frame with two bendable handle rods provided with second coupling members that are rotatable relative to the first coupling members. Each of two retaining sets is disposed between inner engaging walls of the first and second coupling members to arrest relative rotation in a tightened state. Only in a loosened state when the inner engaging walls have been brought away from each other will relative rotation between the first and second coupling members be permitted. Each of two biasing members is disposed between the inner engaging walls to bias the second coupling members to move away from the first coupling members. Each of two tightening rods is inserted into the coupling members, and has a pivot end extending outwardly of the respective second coupling member. A locking member is pivoted on the pivot end and has first and second cam surfaces. When in the loosened state, the first cam surface faces the respective second coupling member. By turning the locking member to bring the second cam surface to move against the biasing action of the respective biasing member, the respective second coupling member can be urged to engage the respective first coupling member.

7 Claims, 9 Drawing Sheets

BODY EXERCISER

BACKGROUND OF THE INVENTION

1. Field of the Invention

This invention relates to a body exerciser, more particularly to a body exerciser including a base frame and a handle frame which is coupled adjustably to the base frame and which has a pair of bendable handle rods to perform different exercise modes.

2. Description of the Related Art

Referring to FIGS. 1, 2 and 3, a conventional body exerciser 1 is shown to include a base frame 1, two coupling units 2, and a handle frame 3. The base frame 1 includes two support rods 101 and a transverse rod 102. The handle frame 3 includes two handle rods 301. Each coupling unit 2 includes first and second coupling members 4,5 which are disposed respectively on the support rod 101 and the handle rod 301, and which have first and second engaging walls 401,501 with bevel gear portions 402,502 that are engagable each other so as to engage the second coupling member 5 to the first coupling member 4. A tightening rod 6 passes through the first and second coupling members 4,5, and is secured to the first coupling member 4 by a screw nut 601. A spring 8 is disposed between the first and second engaging walls 401,501 so as to move the second coupling member 5 away from the first coupling member 4. A locking member 7 is mounted pivotally on the tightening rod 6 such that when the locking member 7 is turned to anchor the second coupling member 5 against the biasing action of the spring 8, the second coupling member 5 will engage the first coupling member 4. Each handle rod 301 includes two rigid segments 302,303, a spring 304 interposed therebetween, and an elastomeric tubular member 305 sleeved on the spring 304 such that one segment 302 is bendable relative to the other segment 303 for exercising purpose.

However, the bevel gear portions 402,502 are complicated in construction, thereby resulting in difficulty during manufacture. In addition, the bevel gear portions 402,502 are liable to wear after a long term of use. Moreover, the locking member 7 is loosened undesirably. Furthermore, each handle rod 301 is not firm in construction.

SUMMARY OF THE INVENTION

The object of the present invention is to provide a body exerciser which has a firm construction and which can operate smoothly and safely.

According to this invention, the body exerciser includes a base frame with a pair of support rods spaced apart from each other in a transverse direction. Each support rod has a first proximate end which is provided with a first coupling member, a first distal end, and a first intermediate portion interposed therebetween. A handle frame includes a pair of bendable handle rods spaced apart from each other in the transverse direction. Each handle rod has a second proximate end provided with a second coupling member, a second distal end, and a second intermediate portion which is bendable and interposed therebetween. The first coupling member has first outer abutment and inner engaging walls opposite to each other in the transverse direction. The second coupling member has second outer abutment and inner engaging walls opposite to each other in the transverse direction. The second inner engaging wall is disposed to face and to be rotatable relative to the first inner engaging wall of a respective first coupling member about an axis. A retaining set includes a plurality of retaining members which are disposed between the respective first and second inner engaging walls to lock the second inner engaging wall of the second coupling member from rotation relative to the first inner engaging wall of the first coupling member in a tightened state. The retaining members are further disposed to be angularly spaced from one another and around the axis such that relative rotation between the first and second inner engaging walls is permitted only in a loosened state when the second inner engaging walls of the second coupling members have been brought in the transverse direction, away from and to steer clear of the first inner engaging walls of the first coupling members. Biasing members are disposed to bias the second inner engaging walls to move away from the first inner engaging walls. A tightening rod includes an abutment end and a pivot end, and passes through the respective first and second coupling members such that the abutment end is brought to abut against the first outer abutment wall and such that the pivot end extends outwardly of the second outer abutment wall in the transverse direction. A locking member is mounted pivotally on the pivot end about a pivot axis, and includes first and second cam surfaces disposed proximate to the pivot axis, and an anchoring end disposed distal to the pivot axis. As such, when the first cam surface is brought to face the second outer abutment wall, the second inner engaging wall is in the loosened state. When the anchoring end is turned to anchor on the second outer abutment wall, the second cam surface will be brought to move against biasing action of the biasing members to abut against the second outer abutment wall so as to place the second inner engaging wall in the tightened state.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
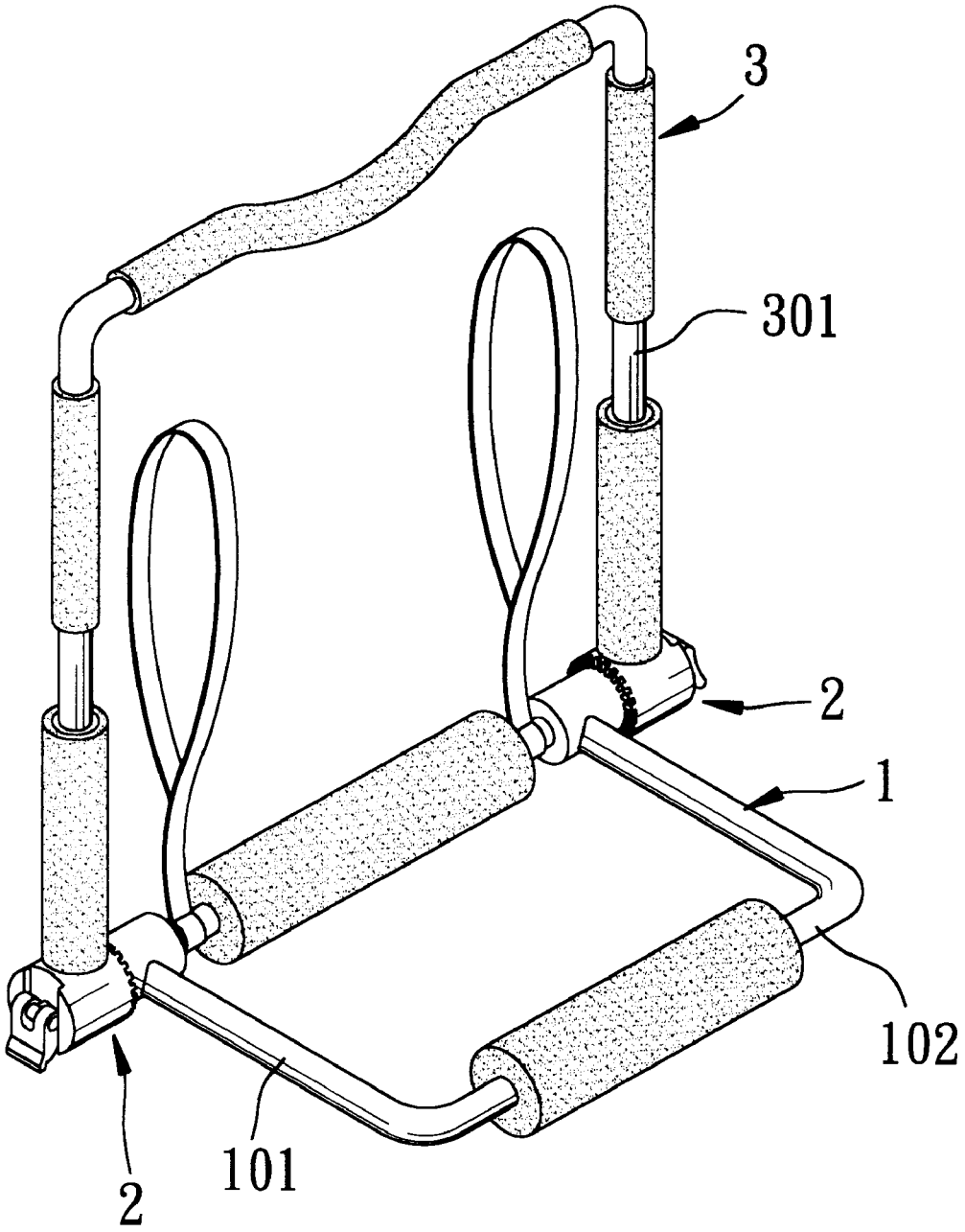
FIG. 1 PRIOR ART
FIG. 1 is a perspective view of a conventional body exerciser.
Figure 2:
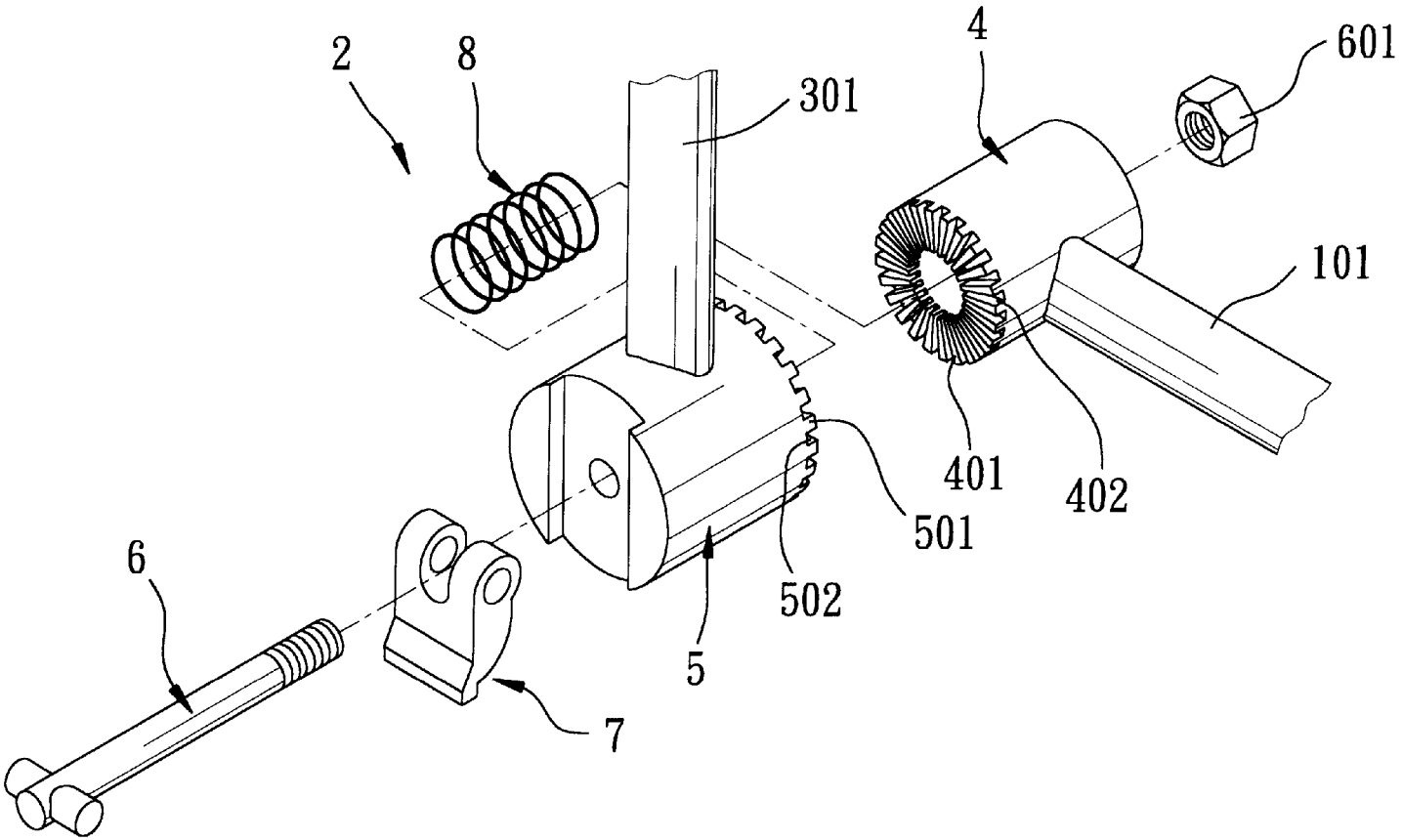
FIG. 2 PRIOR ART
FIG. 2 is an exploded view of coupling members of the conventional body exerciser.
Figure 3:
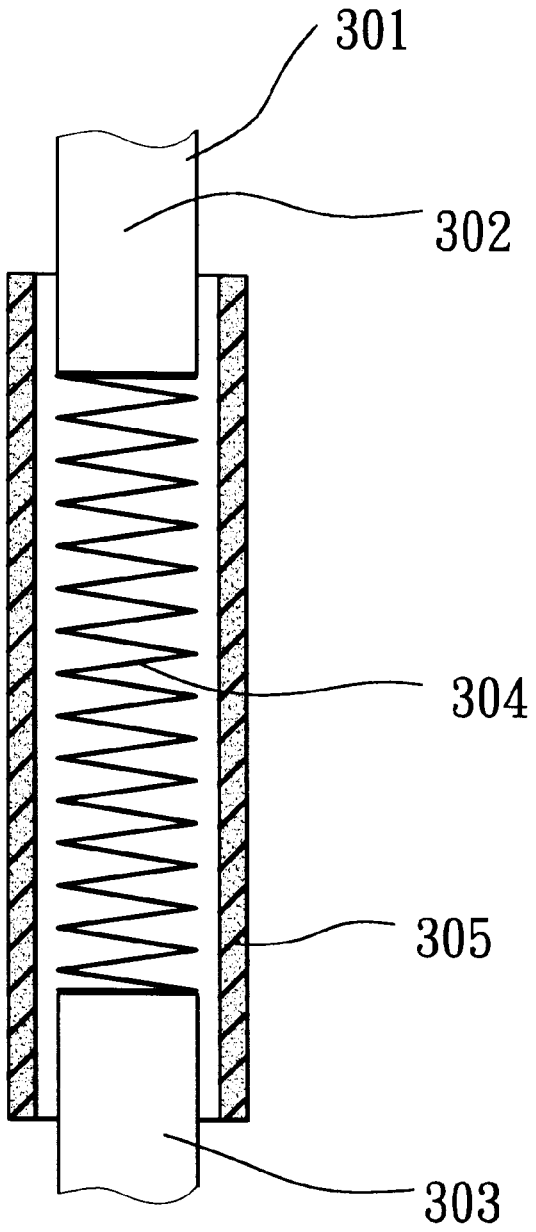
FIG. 3 PRIOR ART
FIG. 3 is a sectional view of a handle rod of the conventional body exerciser.
Figure 4:
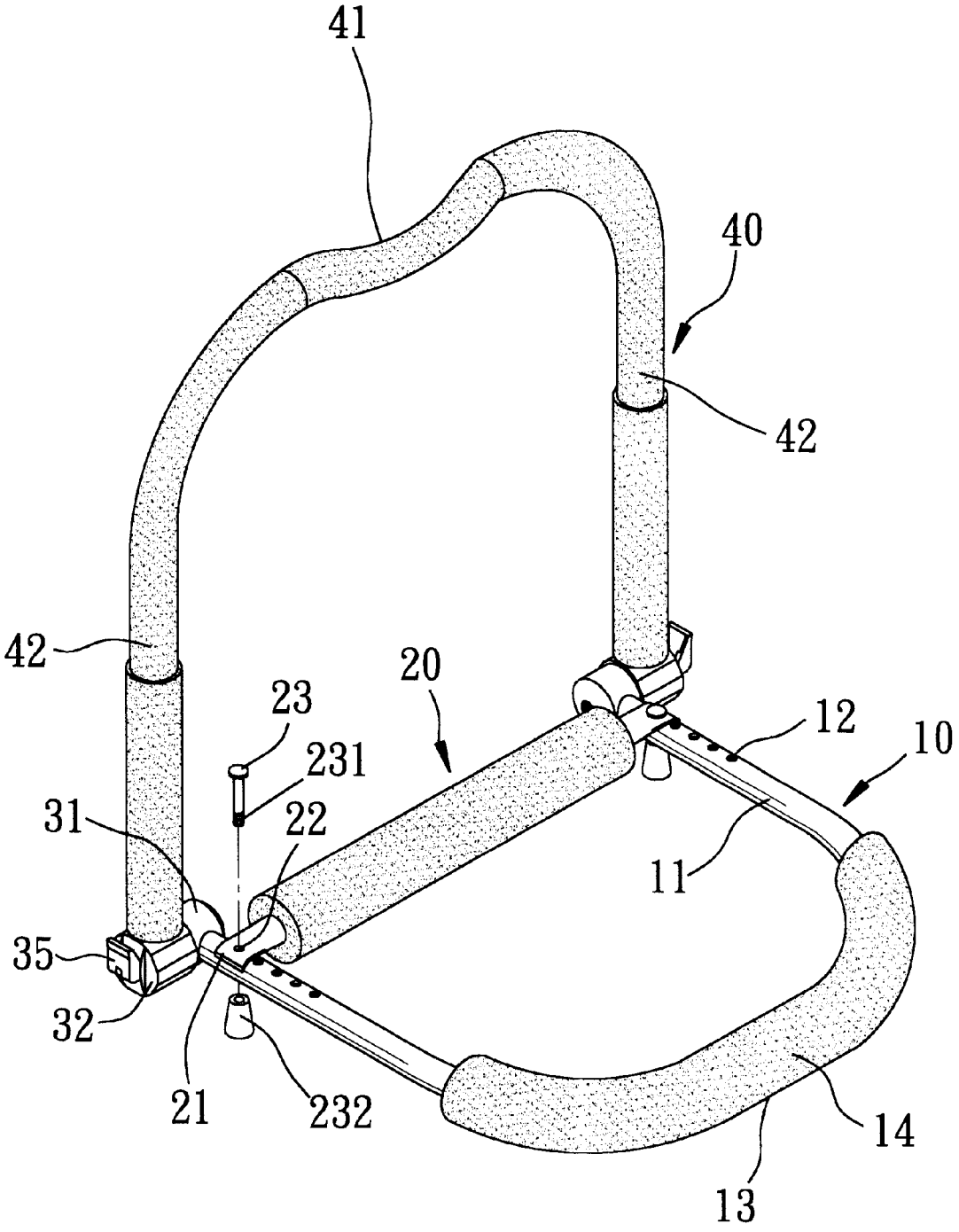
FIG. 4 is a perspective view of a preferred embodiment of a body exerciser according to this invention.

Referring to FIG. 4, the preferred embodiment of the body exerciser according to the present invention is shown to comprise a base frame 10, a prop rod 20, a handle frame 40, a pair of first coupling members 31, and a pair of second coupling members 32.

The base frame 10 is U-shaped, and includes a pair of support rods 11, and a transverse portion 13 which is sleeved with an elastomeric tube 14. Each support rod 11 has a first proximate end, a first distal end, and a first intermediate portion interposed therebetween. Each of the first proximate and distal ends and the first intermediate portion is disposed to be spaced apart from a respective one of the first proximate and distal ends and the first intermediate portion of the other support rod 11 in a first transverse direction. The first intermediate portion of each support rod 11 has a plurality of first lock holes 12 which are arranged in a second transverse direction transverse to the first transverse direction.

The prop rod 20 has two ends 21 which are mounted on the first intermediate portions of the support rods 11. Each end 21 has a second lock hole 22 such that a screw fastener 23 passes through the second lock hole 22 and a selected one of the first lock holes 12, thereby enabling a threaded portion 231 of the screw fastener 23 to engage threadedly a screw socket 232 to fasten adjustably the prop rod 20 to and along the first intermediate portions in the second transverse direction.

Figure 6:
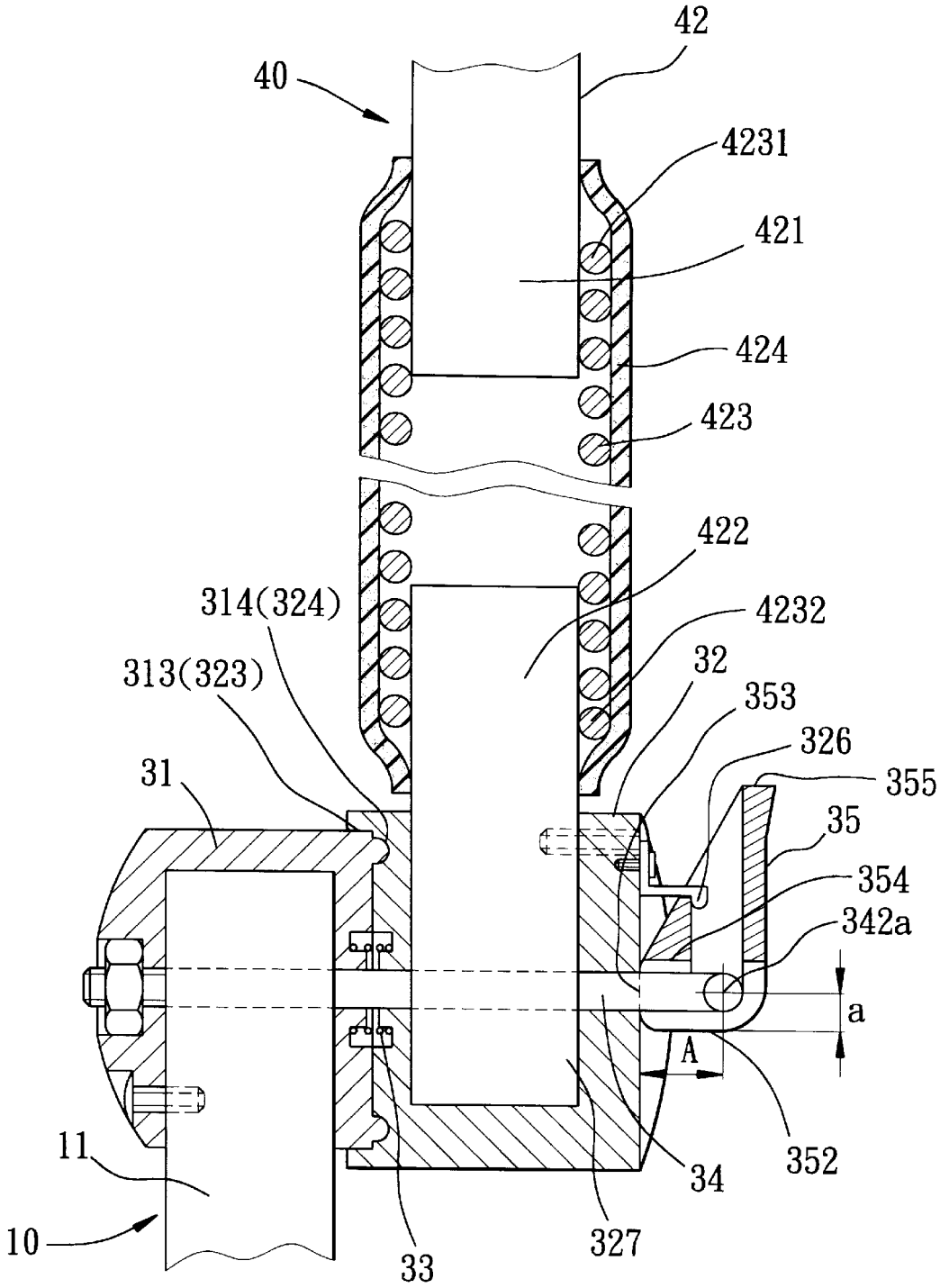
FIG. 6 is a sectional view of the coupling members of the preferred embodiment when in a tightened state.

The handle frame 40 includes a pair of bendable handle rods 42 and a connecting rod 41 therebetween. Each of the second proximate and distal ends 422,421, and the second intermediate portion is disposed to be spaced apart from a respective one of the second proximate and distal ends and the second intermediate portion of the other handle rod 42 in the first transverse direction. With reference to FIG. 6, each handle rod 42 includes second proximate and distal ends 421,422, and a second intermediate portion. The second proximate and distal ends 422,421 are in the form of two rigid segments which are spaced apart from each other in a third transverse direction transverse to the first and second transverse directions. The second intermediate portion is formed of a coiled spring 423 which has third proximate and distal ends 4232,4231 that are sleeved respectively on the rigid segments such that the second distal end 42 is bendable relative to the second proximate end 422, and an elastomeric tubular member 424 which is sleeved on the coiled spring 423 so as to secure the third proximate and distal ends 4232,4231 of the coiled spring 423 to the rigid segments, respectively.

Figure 5:
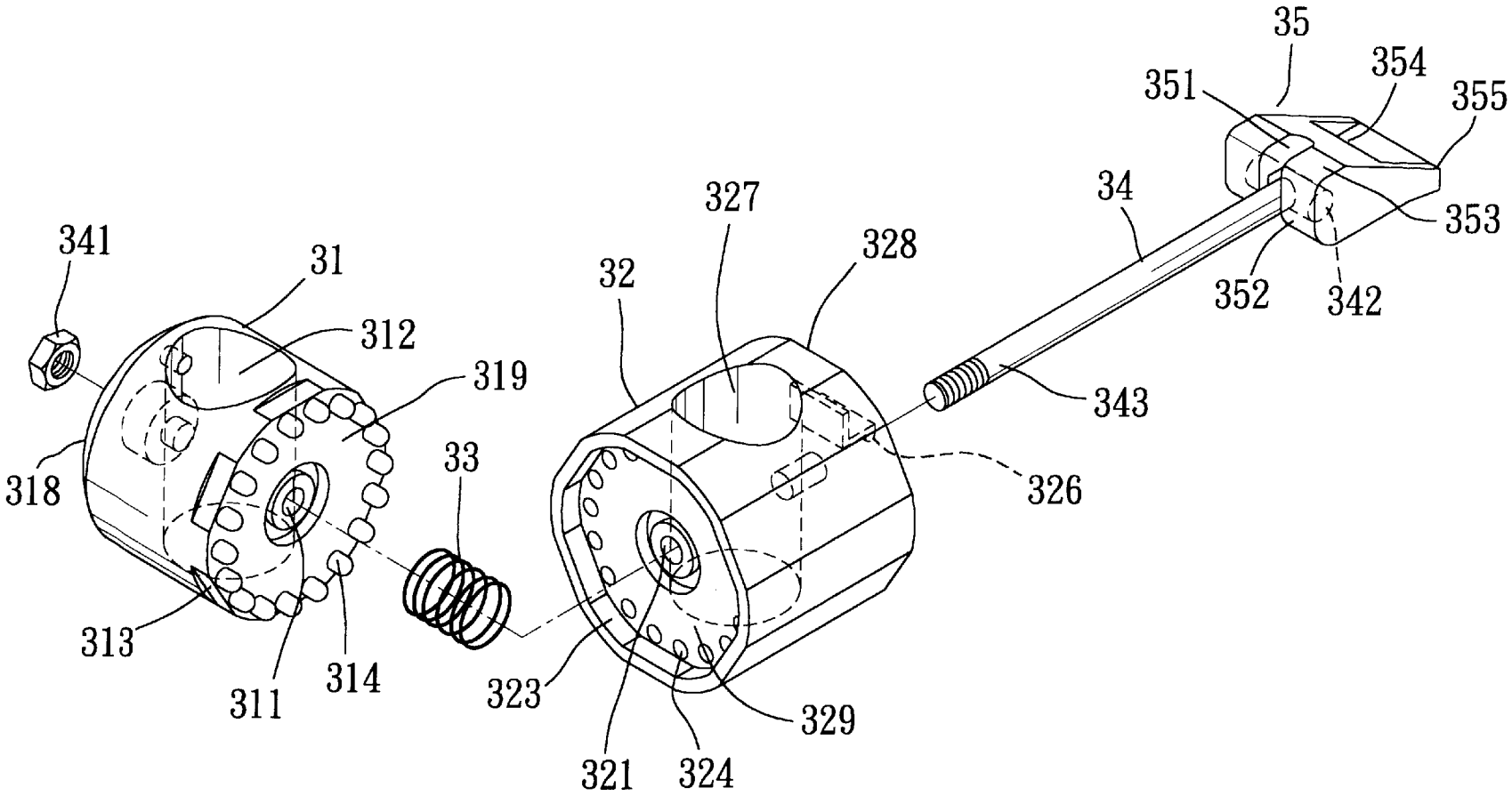
FIG. 5 is an exploded view of coupling members of the preferred embodiment.

Referring to FIGS. 5 and 6, each first coupling member 31 has first outer abutment and inner engaging walls 318,319 opposite to each other in the first transverse direction, a first through hole 311 which extends to communicate the first outer abutment wall 318 with the first inner engaging wall 319 to define a first axis, and a first mounting hole 312 which extends transverse to the first through hole 311 such that the first proximate end of the respective support rod 11 is mounted securely therein.

Each second coupling member 32 has second outer abutment and inner engaging walls 328,329 opposite to each other in the first transverse direction, a second through hole 321 which extends to communicate the second outer abutment wall 328 with the second inner engaging wall 329 to define a second axis, and a second mounting hole 327 which extends transverse to the second through hole 321 such that the second proximate end of the respective handle rod 42 is mounted securely therein. The second inner engaging wall 329 is disposed to face the respective first inner engaging wall 319 about both the first and second axes.

A pair of retaining sets are disposed between the respective first and second coupling members 31,32. Each retaining set includes a plurality of retaining members, each of which includes a pair of protrusion 314 and recess 324 that are disposed respectively on the first and second inner engaging walls 319,329. The protrusions 314 and the recesses 324 are disposed to be angularly spaced from one another and around the first and second axes, respectively. The protrusion 319 and the respective recess 329 can engage each other to lock the second inner engaging wall 329 from rotation relative to the first inner engaging wall 319 in a tightened state. Only in a loosened state, when the second inner engaging wall 329 has been brought in the first transverse direction away from and to steer clear of the first inner engaging wall 319, will relative rotation between the first and second inner engaging walls 319,329 be permitted.

The second coupling member 32 further has an annular inner wall 323 which is formed outwardly of the second inner engaging wall 329. The first coupling member 31 further has an annular notched outer wall 313 which is formed adjacent to the first inner engaging wall 319 so as to engage the inner wall 323 when the second inner engaging wall 329 is in the tightened state.

A biasing member 33 is disposed between the respective first and second inner engaging walls 319,329 to bias the second inner engaging wall 329 to move away from the first inner engaging wall 319.

A tightening rod 34 includes an abutment end 343 and a pivot end 342, and is disposed to be inserted into respective ones of the first and second through holes 319,329 such that the abutment end 343 can be secured in the first coupling member 31 by a nut 341. The pivot end 342 extends outwardly of the second outer abutment wall 328 in the first transverse direction.

Figure 7:
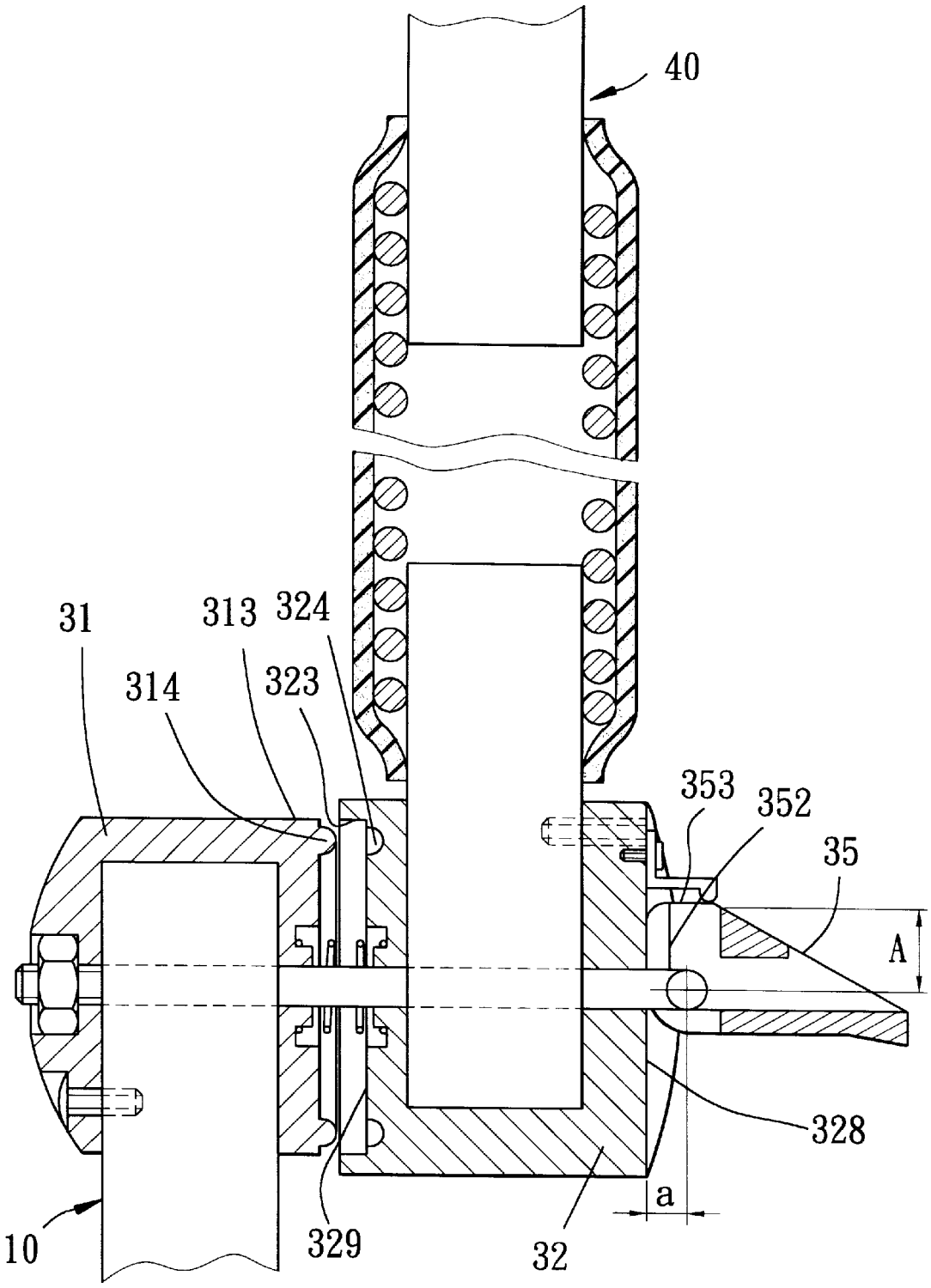
FIG. 7 is a sectional view of the coupling members of the preferred embodiment when in a loosened state.

A locking member 35 has a mounting slot 351 to be pivotally mounted on the pivot end 342 of the respective tightening rod 34 about a pivot axis 342*a*, and includes first and second cam surfaces 352,353 which are disposed proximate to the pivot axis 342*a*, and an anchoring end 355 which is disposed distal to the pivot axis 342*a*. The first cam surface 352 is distant from the pivot axis 342*a* by a first distance (a), and the second cam surface 353 is distant from the pivot axis 342*a* by a second distance (A) which is longer than the first distance (a). As such, referring to FIG. 7, when the first cam surface 352 is brought to face the second outer abutment wall 328, the second inner engaging wall 329 is in the loosened state. By turning the anchoring end 355 about the pivot axis 342*a* to anchor on the second outer abutment wall 328, the second cam surface 353 will be brought to move against the biasing action of the respective biasing member 33 to abut against the second outer abutment wall 328 so as to place the second inner engaging wall 329 in the tightened state, as shown in FIG. 6. In addition, a fastening member includes a notch 354 which is formed in the anchoring end 355, and a hook 326 which is disposed on the second outer abutment wall 329 so as to fit snugly in the notch 354 when the second cam surface 353 abuts against the second outer abutment wall 329.

Figure 8:
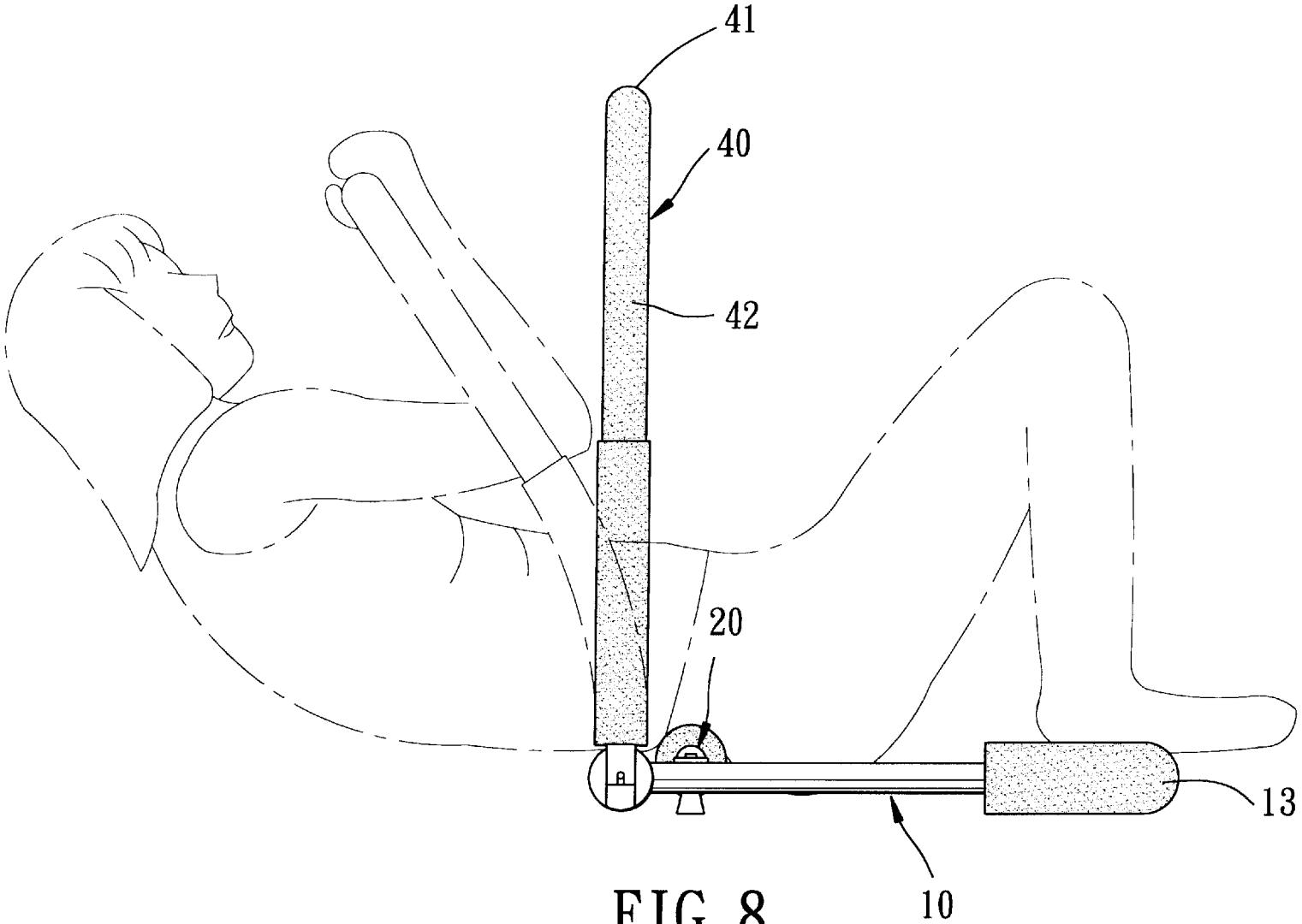
FIG. 8 is a schematic view showing one operating mode of the preferred embodiment.

Referring to FIGS. 4 and 8, when the handle rods 42 of the handle frame 40 are adjusted to be substantially perpendicular to the base frame 10, the user may pass his body through the handle frame 40, and sit between the prop rod 20 and the transverse rod 13. Then, the user grips the connecting rod 41 of the handle frame 40 and pulls the same toward himself by the biasing action of the coiled spring 423 to exercise his arms, back and waist.

Figure 9:
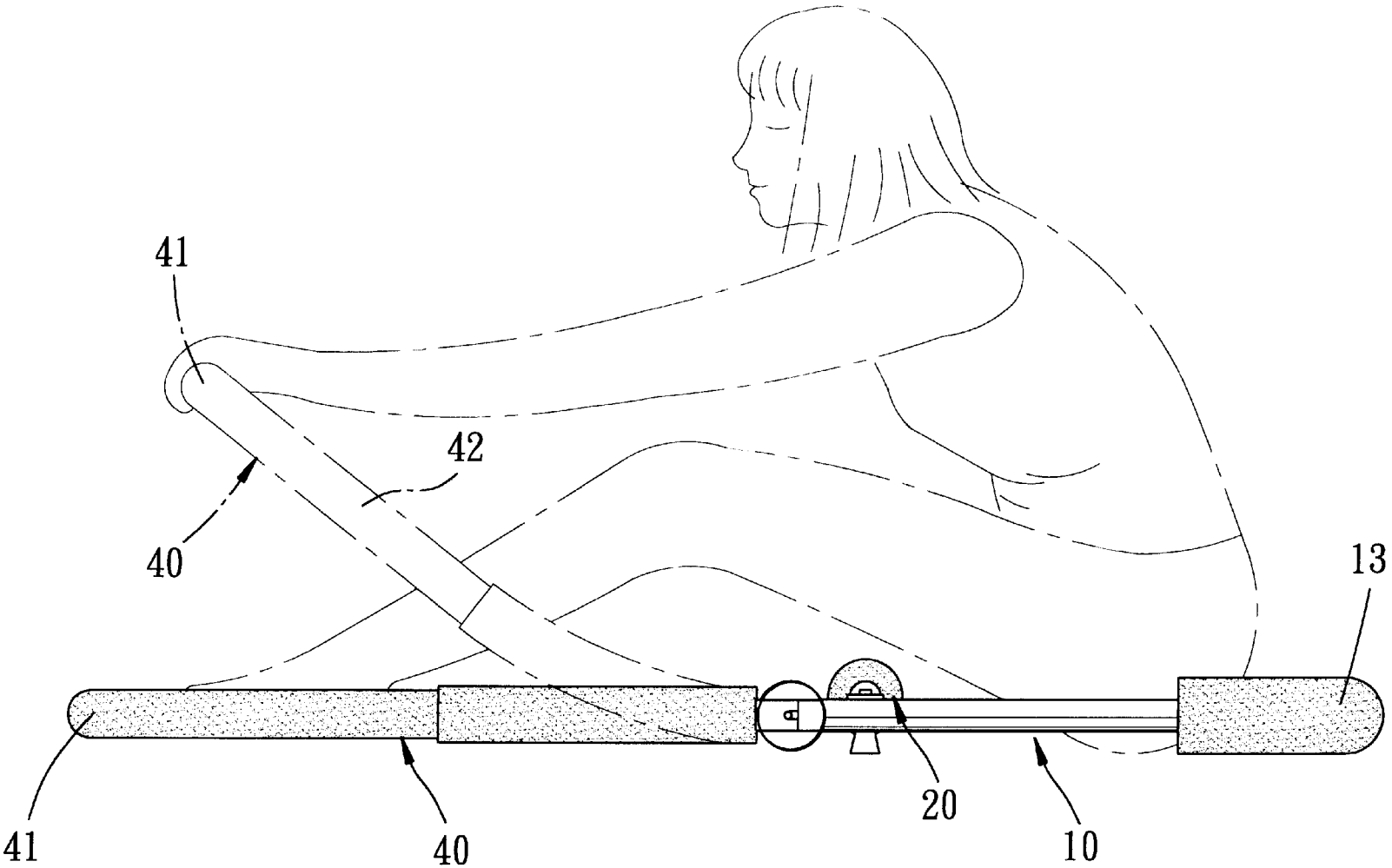
FIG. 9 is a schematic view showing another operating mode of the preferred embodiment.

Referring to FIG. 9, when the handle rods 42 of the handle frame 40 are adjusted to be substantially parallel to the base frame 10, the user may put his legs between the handle rods 42, and sit between the prop rod 20 and the transverse rod 13. Then, the user grips the connecting rod 41 toward himself by the biasing action of the coiled spring 423 to exercise his arms, waist, and abdomen.

As mentioned above, by the engagement between the protrusions 314 and the recesses 324, and by the engagement between the inner and outer walls 323,313, the second coupling member 32 is locked easily from rotation relative to the first coupling member 31 by the guidance of the engagement between the inner and outer walls 323,313. In addition, the first and second coupling members 31,32 have a simple construction that can be easily manufactured.

Moreover, when the second outer abutment wall 328 of each second coupling member 32 is in the tightened state, by the fitting of the hook 326 into the notch 354, the second cam surface 353 abuts against the respective second outer abutment wall 328 firmly, thereby preventing undesired disengagement of the second coupling member 32 from the first coupling member 31.

Furthermore, due to the coiled spring 423 and the tubular member 424 which are sleeved on the rigid segments of the second proximate and distal ends 422,421, each handle rod 42 has a relatively firm construction.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A body exerciser comprising:

a base frame including a pair of support rods, each having a first proximate end, a first distal end and a first intermediate portion interposed therebetween, each of said first proximate and distal ends and said first intermediate portion being disposed to be spaced apart from a respective one of said first proximate and distal ends and said first intermediate portion of the other one of said support rods in a first transverse direction;

a handle frame including a pair of bendable handle rods, each having a second proximate end, a second distal end and a second intermediate portion which is bendable and interposed therebetween, each of said second proximate and distal ends and said second intermediate portion being disposed to be spaced apart from a respective one of said second proximate and distal ends and said second intermediate portion of the other one of said bendable handle rods in the first transverse direction;

a pair of first coupling members, each disposed on said first proximate end of a respective one of said support rods, and having first outer abutment and inner engaging walls opposite to each other in the first transverse direction, and a first through hole extending to communicate said first outer abutment wall with said first inner engaging wall to define a first axis;

a pair of second coupling members, each disposed on said second proximate end of a respective one of said handle rods, and having second outer abutment and inner engaging walls opposite to each other in the first transverse direction, and a second through hole extending to communicate said second outer abutment wall with said second inner engaging wall to define a second axis, said second inner engaging wall being disposed to face and to be rotatable relative to said first inner engaging wall of a respective one of said first coupling members about both said first and second axes;

a pair of retaining sets, each of said retaining sets including a plurality of retaining members which are disposed between said first and second inner engaging walls to lock said second inner engaging wall from rotation relative to said first inner engaging wall in a tightened state, said retaining member being further disposed to be angularly spaced from one another and around said first and second axes such that relative rotation about said first and second axes between said first and second inner engaging walls is permitted only in a loosened state when said second inner engaging wall has been brought in the first transverse direction, away from and to steer clear of said first inner engaging wall;

a pair of biasing members, each disposed to bias said second inner engaging wall of one of said second coupling members to move away from said first inner engaging wall of one of said first coupling member;

a pair of tightening rods, each including an abutment end and a pivot end, and disposed to be inserted into respective ones of said first and second through holes such that when said abutment end is brought to abut against one of said first and second outer abutment walls, said pivot end extends outwardly of the other one of said first and second outer abutment walls in the first transverse direction; and a pair of locking members, each disposed to be pivotally mounted on said pivot end of a respective one of said tightening rods about a pivot axis, and including first and second cam surfaces disposed proximate to said pivot axis, and an anchoring end disposed distal to said pivot axis such that when said first cam surface is brought to face said other one of said first and second outer abutment walls, said second inner engaging wall is in the loosened state, and when said anchoring end is turned about said pivot axis to anchor on said other one of said first and second outer abutment walls, said second cam surface will be brought to move against biasing action of a respective one of said biasing members to abut against said other one of said first and second outer abutment walls so as to place said second inner engaging wall in the tightened state.

2. The body exerciser as claimed in claim 1, wherein each of said retaining members includes a pair of recess and protrusion which are disposed respectively on said first and second inner engaging walls so as to engage each other when said second inner engaging wall is in the tightened state.

3. The body exerciser as claimed in claim 1, wherein said first cam surface is distant from said pivot axis by a first distance, and said second cam surface is distant from said pivot axis by a second distance which is longer than said first distance.

4. The body exerciser as claimed in claim 1, further comprising a pair of fastening members, each including a notch formed in said anchoring end, and a hook disposed on said other one of said first and second outer abutment walls so as to fit snugly in said notch when said second cam surface abuts against said other one of said first and second outer abutment walls.

5. The body exerciser as claimed in claim 1, further comprising a prop rod adapted to provide comfort to the back of a user, and having two ends connected to said first intermediate portions of said support rods and extending in the first transverse direction.

6. The body exerciser as claimed in claim 5, wherein said first intermediate portion of each of said support rods has a plurality of first lock holes arranged in a second transverse direction transverse to the first transverse direction, each of said ends of said prop rod having a second lock hole and a fastener which passes through said second lock hole and a selected one of said first lock holes so as to fasten adjustably said prop rod to and along said first intermediate portions of said support rods in the second transverse direction.

7. The body exerciser as claimed in claim 1, wherein said second proximate and distal ends of each of said handle rods include two rigid segments which are spaced apart from each other in a third transverse direction transverse to the first transverse direction, said second intermediate portion of each of said handle rods being formed of a coiled spring which has third proximate and distal ends that are opposite to each other in the third transverse direction and that are sleeved respectively on said rigid segments such that said second distal end is bendable relative to said second proximate end, and an elastomeric tubular member which is sleeved on said coiled spring so as to secure said third proximate and distal ends of said coiled spring to said rigid segments, respectively.

* * * * *